US006170837B1

(12) United States Patent
Ross

(10) Patent No.: US 6,170,837 B1
(45) Date of Patent: Jan. 9, 2001

(54) WHEEL ASSEMBLY

(76) Inventor: Charles Ross, 12829 Calle de las Rosas, San Diego, CA (US) 92129

( * ) Notice: Under 35 U.S.C. 154(b), the term of this patent shall be extended for 0 days.

(21) Appl. No.: 09/265,065

(22) Filed: Mar. 9, 1999

(51) Int. Cl.[7] ..... A63C 17/04

(52) U.S. Cl. ..... 280/1; 280/11.19; 280/11.201; 280/11.223; 280/11.27

(58) Field of Search ..... 280/11.19, 11.201, 280/11.221, 11.223, 11.226, 11.227, 11.231, 11.27, 3, 1, 11.28; 301/5.3, 6.1; 188/30

(56) References Cited

U.S. PATENT DOCUMENTS

| | | | | |
|---|---|---|---|---|
| 2,122,660 | | 7/1938 | Read et al. | 188/30 |
| 3,790,187 | * | 2/1974 | Radu et al. | 280/11.201 |
| 4,045,047 | | 8/1977 | Buckley | 280/242 |
| 4,334,690 | * | 6/1982 | Klamer et al. | 280/11.201 |
| 4,410,195 | | 10/1983 | Agustin | 280/264 |
| 4,621,825 | | 11/1986 | Lee | 280/218 |
| 5,056,802 | | 10/1991 | Piotrowski | 280/11.115 |
| 5,374,072 | * | 12/1994 | Landers | 280/11.223 |
| 5,441,286 | * | 8/1995 | Pozzobon | 280/11.223 |
| 5,800,022 | * | 9/1998 | Del Rosario | 280/11.223 |
| 5,873,583 | * | 2/1999 | Moore | 280/11.201 |
| 5,941,539 | * | 8/1999 | Pratt | 280/11.223 |
| 5,964,537 | * | 10/1999 | Hill, Jr. | 280/11.223 |
| 5,988,656 | * | 11/1999 | Krah | 280/11.223 |

* cited by examiner

*Primary Examiner*—Richard M. Camby
(74) *Attorney, Agent, or Firm*—Frank G. Morkunas

(57) ABSTRACT

An assembly for wheels which are mountable on objects, such as in-line skates and wheel chairs, which have a frame for receiving the wheel. The assembly has an axle with an axle shaft having a non-circular configuration, which is non-rotationally mountable to the frame; an inner sleeve, having a non-circular orifice corresponding to the axle shaft non-circular configuration, into which the axle inserts; a uni-rotational member, such as a one-way clutch, into which the inner sleeve inserts, the uni-rotational member being non-rotationally insertable into the wheel; and a retaining member having rotational and thrust capabilities insertable on the inner sleeve inside and the wheel, whereby after the axle is inserted into the inner sleeve, the inner sleeve is inserted into the uni-rotational member, the uni-rotational member is inserted into the wheel, the retaining member is inserted over the inner sleeve into the wheel, and the axle is non-rotationally mounted to the frame, the wheel is capable of rotating in only one direction around the inner sleeve by way of the uni-rotational member contained within the wheel thereby preventing any unwanted movement in the opposite direction.

27 Claims, 3 Drawing Sheets

WHEEL ASSEMBLY

CROSS REFERENCES TO RELATED APPLICATIONS

None.

STATEMENT REGARDING FEDERALLY-SPONSORED RESEARCH OR DEVELOPMENT

Not applicable.

BACKGROUND OF THE INVENTION

This present invention relates to an improvement in wheel assemblies, and more particularly to wheel assemblies associated with objects preferably intended to move in one direction such as, but not limited to, in-line skates, wheel chairs, skateboards, and the like.

Typical wheel assemblies used for in-line skates, wheel chairs, skate boards, and similar human-powered objects permit rotation in two directions. This is fine in many cases for many purposes. But in other cases, the user of the object may prefer movement or rotation in only one direction, generally forward. For instance, in skating with in-line skates, a user generally pushes off with one foot while the other foot begins a rear-to-front slide and glide on the ground. The wheels of that skate propel the user forward. With that foot in the forward position, the foot to the rear repeats the same movement. Momentum and speed build as the process repeats and continues. The wheels of the in-line skates are bi-directional. With movement in both directions, as the forward foot becomes the rearward foot, there is some backward movement in that skate. If this movement can be minimized, or better still, prevented, then when a foot is in the forward position it could provide the user with a solid foundation from which the user is able to exert more forward thrust as the other foot begins its forward stride. With bi-directional movement of the wheels, the stability is significantly undermined and only the skill of a user minimizes, but does not eliminate, this unwanted rearward movement of the forward skate. Such a wheel assembly is similarly useful for wheel chairs, particularly when a user is negotiating inclines; for skate boards; and similar human-powered objects.

One prior art patent to Piotrowski, U.S. Pat. No. 5,056,802, provides for a function of propelling oneself forward by alternatively raising the heel portion of the skate and forcing it downward. The '802 patent is a complex structure which employs a combination spur gear, gear track (rack gear) 52, and one-way clutch assembly in combination with an inclined plane to accomplish this purpose. The one-way clutch 56 is used to engage the spur gear 62 with the wheel assembly 30 to produce the desired forward motion when, and only when, another force downward is applied to the inclined plane in the skate. The oneway clutch of the '802 invention will disengage the wheel from the spur gear when the skate is lifted off the ground.

Other brake-oriented and/or directional-control-oriented inventions include the Lee patent for skateboards, U.S. Pat. No. 4,621,825; and the Buckley patent for wheel chairs, U.S. Pat. No. 4,045,047. None of these prior art inventions employ the simplicity or the function of the present invention coupled with its functional superiority.

Accordingly, several objects and advantages of my invention are to:

a. provide a low-cost, interchangeable wheel assembly to objects for uni-directional movement;

b. provide a wheel assembly which is simply constructed and permits movement only in a single direction;

c. provide a wheel assembly which offers braking support in an opposite direction of movement to maximize the efficiency of energy expended; and d. provide for simplicity of use for beginners and experts alike.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates an assembly for wheels which are mountable on objects, such as in-line skates and wheel chairs, which have a frame for receiving the wheel. The assembly has an axle with an axle shaft having a non-circular configuration, which is non-rotationally mountable to the frame; an inner sleeve, having a non-circular orifice corresponding to the axle shaft non-circular configuration, into which the axle inserts; a uni-rotational member, such as a one-way clutch, into which the inner sleeve inserts, the uni-rotational member being non-rotationally insertable into the wheel; and a retaining member having rotational and thrust capabilities insertable on the inner sleeve inside and the wheel, whereby after the axle is inserted into the inner sleeve, the inner sleeve is inserted into the unirotational member, the uni-rotational member is inserted into the wheel, the retaining member is inserted over the inner sleeve into the wheel, and the axle is non-rotationally mounted to the frame, the wheel is capable of rotating in only one direction around the inner sleeve by way of the uni-rotational member contained within the wheel thereby preventing any unwanted movement in the opposite direction.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Figure 1:
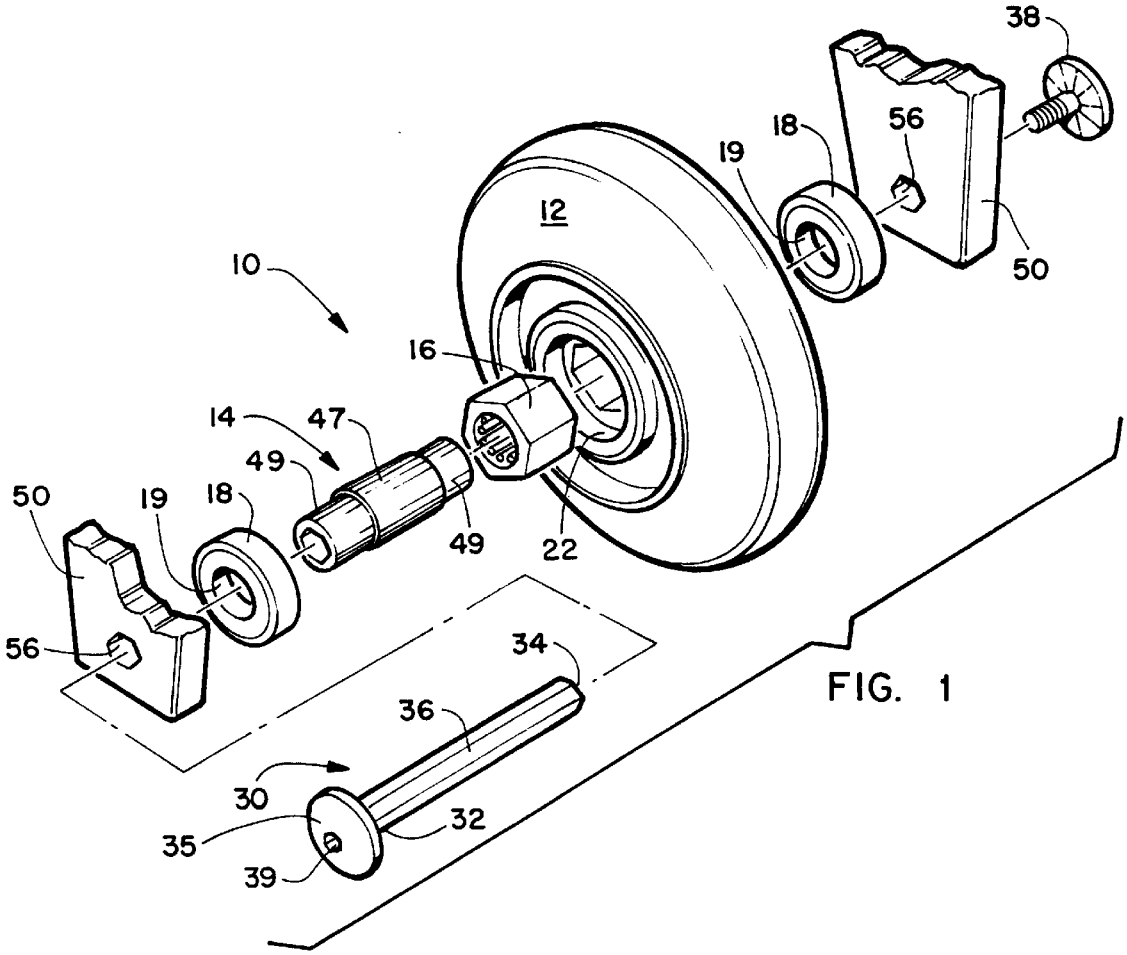
FIG. 1 is an exploded view of the wheel assembly.
Figure 3:
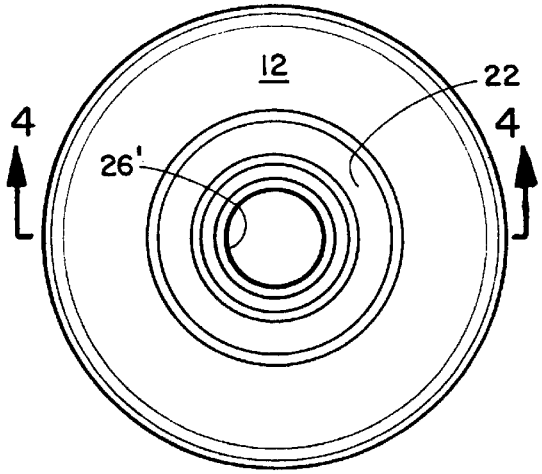
FIG. 3 is a side elevation view of another embodiment of a wheel associated with the wheel assembly.
Figure 2:
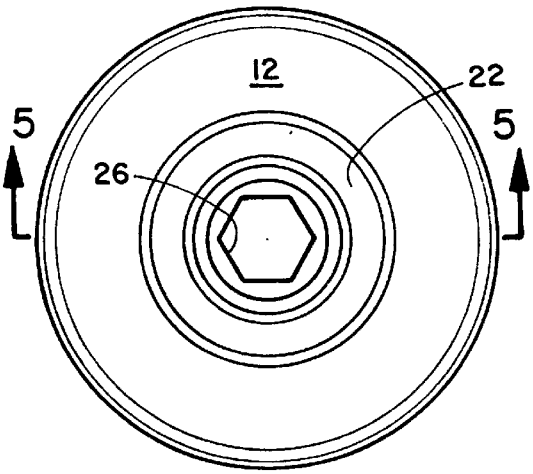
FIG. 2 is a side elevation view of one embodiment of a wheel associated with the wheel assembly.
Figure 4:
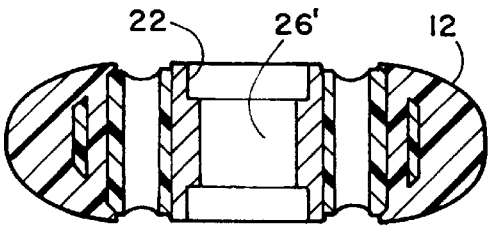
FIG. 4 is a cut-away sectional view of a wheel taken on line 4—4 of FIG. 3.
Figure 5:
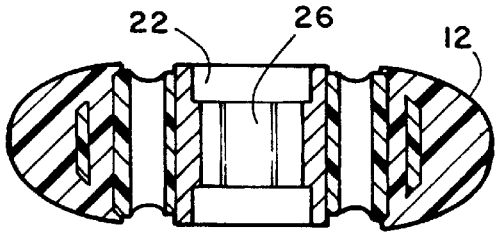
FIG. 5 is a cut-away sectional view of another embodiment of a wheel taken on line 5—5 of FIG. 2.
Figure 6:
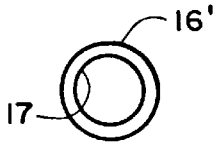
FIG. 6 is an end view of one embodiment of a uni-directional member.
Figure 7:
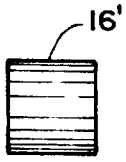
FIG. 7 is a side view of one embodiment of a uni-directional member.
Figure 8:
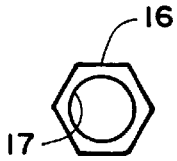
FIG. 8 is an end view of another embodiment of a uni-directional member.
Figure 9:
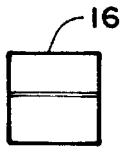
FIG. 9 is a side view of the other embodiment of a uni-directional member.

Referring now to the drawings in detail and in particular to FIG. 1, reference character 10 generally designates an wheel assembly constructed in accordance with a preferred embodiment of the present invention. The unique wheel assembly consists of an a uni-directional member 16 which securely inserts into a central orifice 26 of a suitable wheel 12. A typical such uni-directional member 16 may include, but is not limited to a conventional one-way clutch device (such as a Torrington Roller Clutch, model number FC-10, or similar conventional clutch mechanism), or any such member suited for the intended purpose of permitting movement or rotation in one direction only. In my preferred embodiment as illustrated in FIGS. 1, 8, and 9, this uni-directional member 16 has a non-circular perimeter tailored to snugly and non-rotationally fit into a similarly configured non-circular central orifice 26 of the wheel 12 (see FIGS. 2 and 5). This is used in instances where the particular wheel 12 has a non-circular central orifice 26 or in another embodiment of my invention which includes a wheel as an integral part of the entire assembly. The non-circular aspect of the central orifice 26 and the non-circular perimeter of the uni-directional member 16 facilitates a snug, non-rotational fit of the uni-directional member 16 into the central orifice 26 without need for bonding the two together. The non-circular configuration may be, but is not limited to, elliptical, oblong, triangular, four-cornered, pentagonal, hexagonal, septagonal, octagonal, and the like, or any similar configuration suited for the intended purpose.

Another embodiment of my invention, as illustrated in FIGS. 3, 4, 6, and 7, incorporates a uni-directional member 16' having a somewhat circular outer perimeter tailored to snugly fit into a central orifice 26' of a conventional wheel 12 which has a similarly configured somewhat circular central orifice 26'. In such configurations wherein the outer perimeter of the uni-directional member 16' is somewhat circular and the central orifice 26' of the wheel 12 is also somewhat circular, generally bonding of the uni-directional member 16' to the central orifice 26' of the wheel 12 will be required. Any manner of bonding will suffice provided the bond created generally maintains the uni-directional member 16' firmly and non-rotationally inside the wheel 12.

Figure 10:
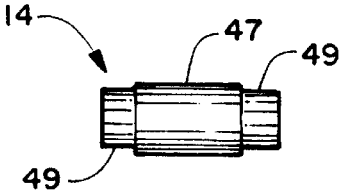
FIG. 10 is a side view of the inner sleeve.
Figure 11:
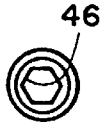
FIG. 11 is an end view of the inner sleeve.
Figure 12:
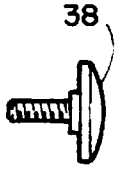
FIG. 12 is a side view of an end piece fastener for the axle assembly.
Figure 13:
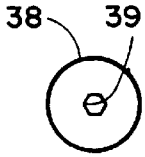
FIG. 13 is an end view of an end piece fastener for the axle assembly.

In either embodiment, the inner sleeve 14, as discussed below, inserts into the uni-directional member 16. Referring now to FIGS. 1, 10, and 11, the inner sleeve 14 has a main body 47 which seats into the uni-directional member orifice 17 such that the wheel 12 will rotate only in one direction and will not permit movement in the opposite direction. One or more extensions 49 project from the main body 47. Two such extensions are preferred. A longitudinal orifice 46 transverses the length of the inner sleeve 14. Typically, this orifice should be non-circular in configuration. Typical such configurations include, but are not limited to, elliptical, oblong, triangular, four-cornered, pentagonal, hexagonal, septagonal, octagonal, and the like, or any similar configuration suited for the intended purpose.

The inner sleeve 14 is secured into the wheel 12 and aligned thereby with the uni-directional member 16 by retaining member 18 which securely seats into the wheel 12 on either or both sides of the wheel 12. A typical retaining member 18 consists of a conventional bearing having rotational and thrust capabilities seated into a recess 22 on one or both sides of the wheel 12. A typical such bearing is an SKF ground precision ball bearing, or any similar conventional bearing suited for the intended purpose.

Figure 14:
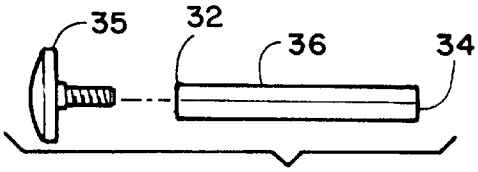
FIG. 14 is a side view of an axle shaft.
Figure 15:
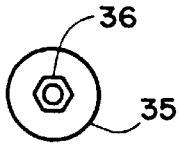
FIG. 15 is an end view of an axle shaft.

The inner orifice 19 of the retaining member 18 seats onto the extension 49 of the inner sleeve. An axle assembly 30 secures the wheel assembly 10 to a frame on any object suited for movement under human power such as, but not limited to in-line skates, roller skates, wheel chairs, skateboards, and the like. This axle assembly 30 has a cap 35 at one end 32, a threaded orifice or threaded central bore at the other end 34 into which a fastener or end cap 38 mates to hold the axle assembly onto a frame, and an axle shaft 36 in between. The cap 35 may be permanently affixed to the axle shaft 36 or it may be removable. If the cap is removable, it has a threaded extension and the axle shaft 36 at that end 32 has corresponding threading such that the cap 35 may be easily inserted or removed from the axle shaft 36 (FIG. 14 illustrates this configuration).

Reference is now made to FIGS. 1 and 11–15. In configurations where the cap 35 is removable, either end of the axle shaft 36 may first be inserted through frame opening 56 and into and through the wheel 12. Regardless, the axle shaft 36 is configured in fitting cooperation with the non-circular orifice 46 of the inner sleeve 14. The purpose here is for the axle shaft 36 to mate with the non-circular orifice 46 of the inner sleeve 14. In this regard, the axle shaft 36 is first inserted into a suitable frame structured such that the frame can non-rotationally accept the axle shaft 36 and thereby prevent the axle shaft 36 from rotating. One manner in which this may be accomplished is by configuring a frame opening in a similar corresponding manner as the axle shaft 36 is configured; i.e., with matching non-circular configurations as previously described. FIG. 1 illustrates such a configuration as yet another embodiment of my invention which includes a frame 50, with a frame opening 56, which opening 56 is adapted to correspond with the configuration of the axle shaft 36. It is to be understood that any method of affixing the axle to the frame to prevent its rotational is what is important.

In practice, the axle shaft 36 is inserted into the frame opening 56, passing through the first bearing 18, mating with the corresponding non-circular orifice 46 of the inner sleeve 14, out through the second bearing 18 in this embodiment, past the other frame opening 56, for ultimate securing thereto by a axle end cap 38 threaded such that the end cap fastener 38 securely mates with the threaded opening at that end 34 of the axle shaft 36. The wheel 12 and wheel assembly 10 are now secured to the desired moveable object in such a fashion that permit the wheel(s) and object to move only in one direction.

Figure 17:
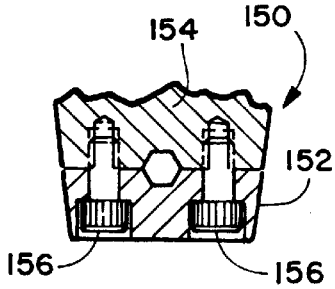
FIG. 17 is a detailed sectional view of a frame assembly.
Figure 16:
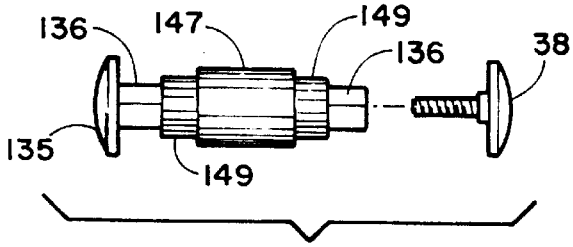
FIG. 16 is a side view of a combination axle shaft and sleeve.
Figure 18:
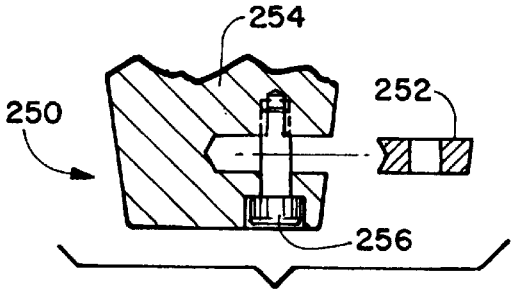
FIG. 18 is a detailed sectional view of another embodiment of a frame assembly.

Another embodiment of the axle assembly 130 is illustrated in FIG. 16. In this embodiment the previously described axle 36 and the previously described inner sleeve 14 are comprised of a single unit 130 having a main body 147, two proximal extensions 149 protruding longitudinally therefrom, and two distal extensions 136 protruding longitudinally from the two proximal extensions 149. A head 135 preferrably is permanently affixed to one end of one distal extension and an end cap 38 is removably connectable to the other end of the distal extension. The distal extensions 136 are structured as non-circular extensions as described above for the non-circular structure of the axle shaft 36. FIGS. 17 and 18 illustrate the frame structures 150 and 250 for use in combination with this embodiment axle assembly 130. Frame structure 150 has a main body 154 and a removable body 152 which is secured to the main body 154 by removable fasteners 156. Any conventional fastener may be used such as, but not limited to set screws, bolts, or any similar fastener suited for the intended purpose. FIG. 18 illustrates yet another embodiment of a frame structure 250 having one removable body 252 which is removable for a main body 254. The removable body 252 is held onto the main body 254 by removable fasteners 256. Any conventional fastener may be used such as, but not limited to set screws, bolts, or any similar fastener suited for the intended purpose.

Figure 19:
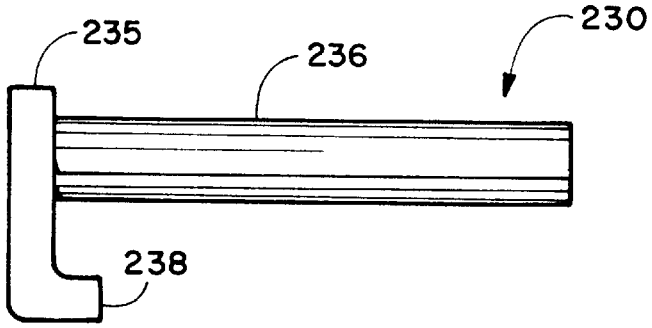
FIG. 19 is a side view of another embodiment of an axle assembly.
Figure 20:
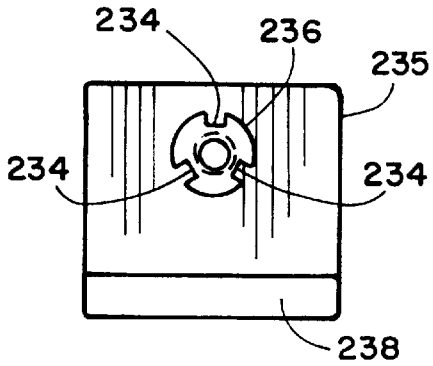
FIG. 20 is an end view of the axle assembly shown in FIG. 19.
Figure 21:
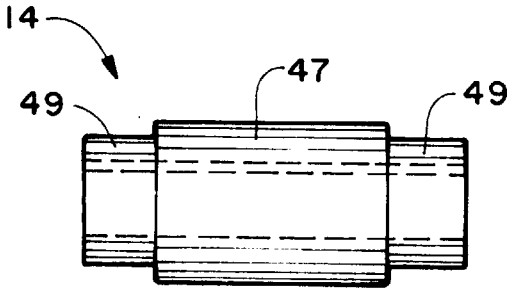
FIG. 21 is a side view of another embodiment of an inner sleeve.
Figure 22:
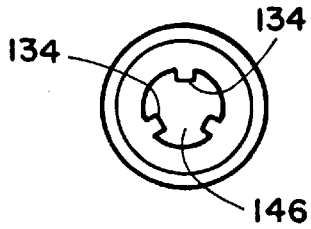
FIG. 22 is an end view of the inner sleeve shown in FIG. 21.
Figure 23:
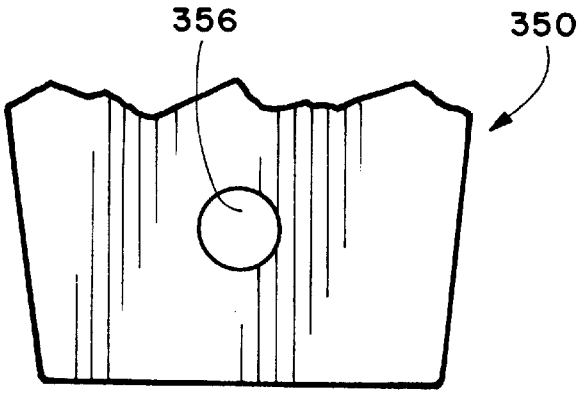
FIG. 23 is a side view of a frame having a circular orifice.

A third type of axle assembly is illustrated in FIGS. 19 and 20. This axle assembly 230 is generally a single-piece member having a cap 235 to which an axle shaft 236 is attached. The axle shaft 236 has grooves or ribs 234 for registration or keying into a correspondingly configured orifice. At least one such groove or rib 234 will suffice but more than one may be used. Below the cap 235 is a protruding lip 238 which holds the axle assembly 230 in non-rotational place when secured onto a frame 50 or 350. The other end of the axle has a threaded central bore into which an end cap 38, as previously described, threads and secures the axle assembly to the frame. FIGS. 21 and 22 illustrate an inner sleeve 14 configured to accept and mate with the spline-like axle shaft 236 described above. The inner diameter 146 of this sleeve 14 is somewhat circular and having at least one or more ribs or grooves 134 which are configured to mate with the axle 236. It is to be understood that either grooves or ribs may be on either axle shaft 236 or inner diameter 146 provided they are configured such that they provide the necessary non-rotational registration of axle shaft 236 to sleeve 14. This embodiment axle assembly 230 with sleeve having corresponding ribs or grooves 134 is suited for devices whose frame 50 is not configured in a non-circular manner but is configured as a circular orifice 356 as illustration in FIG. 23.

The present disclosure includes that contained in the present claims as well as that of the foregoing description. Although this invention has been described in its preferred forms with a certain degree of particularity, it is understood that the present disclosure of the preferred forms has been made only by way of example and numerous changes in the details of construction and combination and arrangement of parts may be resorted to without departing from the spirit and scope of the invention. Accordingly, the scope of the invention should be determined not by the embodiments illustrated, but by the appended claims and their legal equivalents.

The invention claimed is:

1. An assembly for wheels which are mountable on objects having a frame for receiving the wheel, said assembly comprising:

a. an axle having an axle shaft, said axle being non-rotationally mountable to the frame;

b. an inner sleeve having a longitudinal orifice into which said axle inserts;

c. a uni-rotational member into which said inner sleeve inserts, said uni-rotational member being non-rotationally insertable into the wheel; and d. retaining means for retaining said inner sleeve inside said wheel, said retaining meanings having rotational and thrust capabilities;

whereby after said axle is inserted into said inner sleeve, said inner sleeve is inserted into said uni-rotational member, said uni-rotational member is inserted into the wheel, said retaining means is inserted over said inner sleeve into the wheel, and said axle is non-rotationally mounted to the frame, the wheel is capable of rotating in only one direction around the inner sleeve by way of the uni-rotational member contained within the wheel thereby preventing any unwanted movement in the opposite direction.

2. The assembly as defined in claim 1 wherein said inner sleeve and said axle further comprise a means for preventing said axle from rotating within said inner sleeve.

3. The assembly as defined in claim 2 wherein said means for preventing said axle from rotating within said inner sleeve comprises said longitudinal orifice having a non-round configuration and said axle shaft having a corresponding non-round configuration.

4. The assembly as defined in claim 3 wherein said non-round configuration is somewhat elliptical.

5. The assembly as defined in claim 3 wherein said non-round configuration has three or more sides and three or more angles.

6. The assembly as defined in claim 3 wherein said non-round configuration is somewhat oblong.

7. The assembly as defined in claim 2 wherein said means for preventing said axle from rotating within said inner sleeve comprises a registration means within said longitudinal orifice and on said axle shaft for registering said shaft to said longitudinal orifice in a non-rotational connection.

8. The assembly as defined in claim 7 wherein said registration means comprises at least one longitudinal groove on said axle shaft and at least one corresponding longitudinal rib on said longitudinal orifice.

9. The assembly as defined in claim 7 wherein said registration means comprises at least one longitudinal rib on said axle shaft and at least one corresponding longitudinal groove on said longitudinal orifice.

10. The assembly as defined in claim 7 further comprising a cap on one end of said axle shaft, said cap having an inwardly protruding lip adapted to engage the frame and thereby non-rotationally maintain said axle to the frame.

11. The assembly as defined in claim 1 wherein said retaining means comprise one or more bearings having bi-directional rotational capabilities.

12. A wheel assembly for wheels which are mountable on objects having a frame for receiving the wheel assembly, said wheel assembly comprising:

a. a wheel having a central orifice and a recess adjacent to said central orifice on each side of said wheel;

b. an axle having an axle shaft, said axle being non-rotationally mountable to the frame;

c. an inner sleeve having a longitudinal orifice into which said axle inserts;

d. a uni-rotational member into which said inner sleeve inserts, said uni-rotational member being non-rotationally insertable into said central orifice; and d. retaining means for retaining said inner sleeve inside said wheel, said retaining meanings having rotational and thrust capabilities and being insertable into said recess;

whereby after said axle is inserted into said inner sleeve, said inner sleeve is inserted into said uni-rotational member, said uni-rotational member is inserted into the wheel, said retaining means is inserted into said recess, and said axle is non-rotationally mounted to the frame, said wheel is capable of rotating in only one direction around the inner sleeve by way of the uni-rotational member contained within the central orifice thereby preventing any unwanted movement of said wheel in the opposite direction.

13. The assembly as defined in claim 12 wherein said inner sleeve and said axle further comprise a means for preventing said axle from rotating within said inner sleeve.

14. The assembly as defined in claim 13 wherein said means for preventing said axle from rotating within said inner sleeve comprises a longitudinal orifice having a non-round configuration and said axle shaft having a corresponding non-round configuration.

15. The assembly as defined in claim 14 wherein said non-round configuration is somewhat elliptical.

16. The assembly as defined in claim 14 wherein said non-round configuration has three or more sides and three or more angles.

17. The assembly as defined in claim 14 wherein said non-round configuration is somewhat oblong.

18. The assembly as defined in claim 13 wherein said means for preventing said axle from rotating within said inner sleeve comprises a registration means within said longitudinal orifice and on said axle shaft for registering said shaft to said longitudinal orifice in a non-rotational connection.

19. The assembly as defined in claim 18 wherein said registration means comprises at least one longitudinal groove on said axle shaft and at least one corresponding longitudinal rib on said longitudinal orifice.

20. The assembly as defined in claim 18 wherein said registration means comprises at least one longitudinal rib on said axle shaft and at least one corresponding longitudinal groove on said longitudinal orifice.

21. The assembly as defined in claim 18 further comprising a cap on one end of said axle shaft, said cap having an inwardly protruding lip adapted to engage the frame and thereby non-rotationally maintain said axle to the frame.

22. The assembly as defined in claim 12 wherein said retaining means comprise one or more bearings having bi-directional rotational capabilities.

23. The assembly as defined in claim 12 further comprising a means for non-rotationally mounting said uni-directional member to said wheel.

24. The assembly as defined in claim 23 wherein said non-rotationally mounting means comprises said inner orifice of said wheel having a non-round configuration and an outer surface of said uni-directional member having a corresponding non-round configuration.

25. The assembly as defined in claim 24 wherein said non-round configuration is somewhat elliptical.

26. The assembly as defined in claim 24 wherein said non-round configuration has three or more sides and three or more angles.

27. The assembly as defined in claim 24 wherein said non-round configuration is somewhat oblong.

* * * * *